US005513724A

United States Patent [19]

De Jong

[11] Patent Number: 5,513,724

[45] Date of Patent: May 7, 1996

[54] COMPENSATION AND ROPE ELONGATION ARRANGEMENT

[75] Inventor: Johannes De Jong, Järvenpää, Finland

[73] Assignee: Kone Oy, Helsinki, Finland

[21] Appl. No.: 222,939

[22] Filed: Apr. 5, 1994

[30] Foreign Application Priority Data

| | | | |
|---|---|---|---|
| Apr. 5, 1993 | [FI] | Finland | 931523 |
| Jun. 24, 1993 | [FI] | Finland | 932927 |

[51] Int. Cl.[6] ..... B66B 11/08

[52] U.S. Cl. ..... 187/264; 187/343

[58] Field of Search ..... 187/264, 343, 187/404, 266, 344; 182/141

[56] References Cited

U.S. PATENT DOCUMENTS

| | | | |
|---|---|---|---|
| 3,174,585 | 3/1965 | Tofanelli | 187/264 |
| 3,653,467 | 4/1972 | Showalter | 187/22 |
| 3,882,968 | 5/1975 | Suozzo | 187/22 |
| 4,069,897 | 1/1978 | Solymos | 187/343 |
| 4,709,646 | 12/1987 | Sadler et al. | 187/343 |
| 5,036,954 | 8/1991 | Haatikivi et al. | 187/343 |

FOREIGN PATENT DOCUMENTS

| | | |
|---|---|---|
| 1251926 | 10/1967 | Germany . |
| 395086 | 4/1991 | Japan . |

*Primary Examiner*—Kenneth Noland

[57] ABSTRACT

The invention relates to a compensation system in an elevator comprising an elevator car (2), a counterweight (3), a set of elevator suspension ropes (11) on which the elevator car (2) and the counterweight (3) are suspended, a traction sheave (5) whose motion is transmitted via the suspension ropes (11) to the elevator car (2) and to the counterweight (3), and a set of compensating ropes (4) and at least one diverting pulley (15) belonging to the suspension rope system (11) and at least one buffer arrangement (9) for the counterweight (3). The suspension ratio of the compensating rope (4) is the same as that of the suspension ropes (11), or multiplied by a coefficient. The rope suspension ratio on the side of the elevator car (2) is the same as or different than on the side of the counterweight (3). For the compensation of the elongation of the suspension and compensating ropes (11 and 4) of the elevator, a buffer (23) below the counterweight (3) has a provision for vertical adjustment.

20 Claims, 4 Drawing Sheets

COMPENSATION AND ROPE ELONGATION ARRANGEMENT

Figure 1:
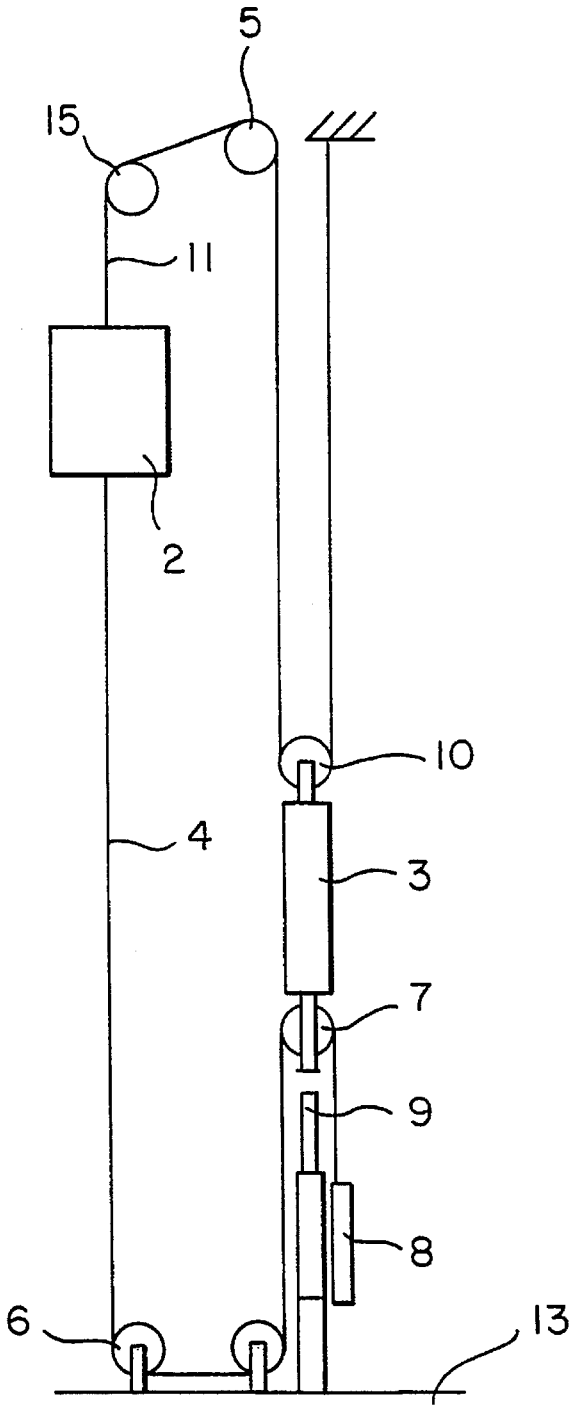

The present invention relates to a compensation system in an elevator according to the and to a system for compensating tile elongation of elevator ropes.

In elevators with a large hoisting height, compensating ropes are needed to balance the moment of unstability caused by the hoisting ropes and generated when the elevator is moving. Without balancing, the motor would have to be considerably bigger and the effect would become worse according to height. If the height in the shaft increases sufficiently without compensation, a situation will arise where the friction is insufficient. High-rise elevators employ compensating ropes which are tightened by means of a compensation tension weight.

In high-rise buildings, the elevators travel at a high velocity and in malfunction situations (gripping, hitting the buffers) both the car and the counterweight may bounce through relatively long distances before their kinetic energy is exhausted. The result is a strong impact on the ropes, which may damage the elevator structures or injure people. For this reason, the compensation tension equipment in fast elevators is provided with a bounce eliminator. This bounce eliminator also reduces the space needed at the top of the shaft because less bouncing headroom is required.

In high-rise buildings where the suspension ratio of the suspension ropes for the car and counterweight is 2:1, it is often necessary to use many compensating or balancing ropes and a very heavy tension weight. Sometimes this need for compensation is so great that the moment caused by the suspension ropes cannot be fully compensated, with the consequence that the motor size is increased.

DE publication 251926 presents a solution in which the path of the counterweight is halved and the counterweight is placed in the lower part of the shaft. In FI patent 82823, tile path of the counterweight is halved and placed in the upper part of the shaft. Unfortunately, there is currently no compensation system for these solutions, which is why it has been necessary to use large motors in them and also the height has been limited because of the friction.

The object of the present invention is to achieve a solution in which the required number of compensating ropes is always used and the moment needed by the motor is minimal. Inadequate compensation, i.e. a situation where the moment of the motor increases when the number of compensating ropes used is insufficient, is no longer unavoidable in high-rise buildings where the suspension ratio of the car and counterweight is 2:1. This is achieved by using, among other things, a 2:1 suspension for compensation on the side of the car and counterweight instead of the 1:1 compensation ratio used at present. As a result of this, the number of compensating ropes required is halved and also the weight of the compensation tension device is reduced. This suspension ratio can be further increased, in which case the number of compensating ropes and the weight of the compensation tension device are reduced.

The present invention provides a compensation solution for elevators in which the path of the counterweight has been halved. This is achieved by using a suspension ratio of 1:1 for the suspension and compensating ropes at the car-side end and a corresponding ratio of 2:1 for both ropes at the counterweight-side end. The number of compensating ropes can be reduced so that the compensation suspension ratios on the car side and on the counterweight side are the ratios of the elevator suspension ropes multiplied by a coefficient, e.g. in such a way that the suspension ratio of the suspension ropes on the car side is 1:1 and 2:1 on the counterweight side and the suspension ratio of the compensating ropes is 2:1 on the car side and 4:1 on the counterweight side, and also in such a way that these compensation suspension ratios are 3:1 on the car side and 6:1 on the counterweight side, and so on.

In all the cases mentioned above, the mutual suspension ratio of the suspension ropes and compensating ropes is the same or multiplied by a constant in relation to each other, yet so that the suspension ratio for the car may be different from that for the counterweight. As an example, consider a case where the suspension ratio of the suspension ropes of the car is 1:1 and the suspension ratio of the suspension ropes of the counterweight is 2:1. The compensation can now be such that the compensation suspension ratio on the car side and on the counterweight side is obtained by multiplying the rope suspension ratios of the car and counterweight by a coefficient n. For example, if n=3, the compensation suspension ratio on the car side in the above-mentioned cases will be 3:1 and the compensation suspension ratio for the counterweight will be 6:1. Previously known cases are situations where the ratio of the suspension ropes of the car and counterweight is 1:1 and the suspension ratio of the compensating ropes 1:1. Another known case is one where the suspension ratio of the car and counterweight is 2:1 and the suspension ratio of the compensating ropes 1:1. The present invention does not apply to these previously known cases.

Figure 4:
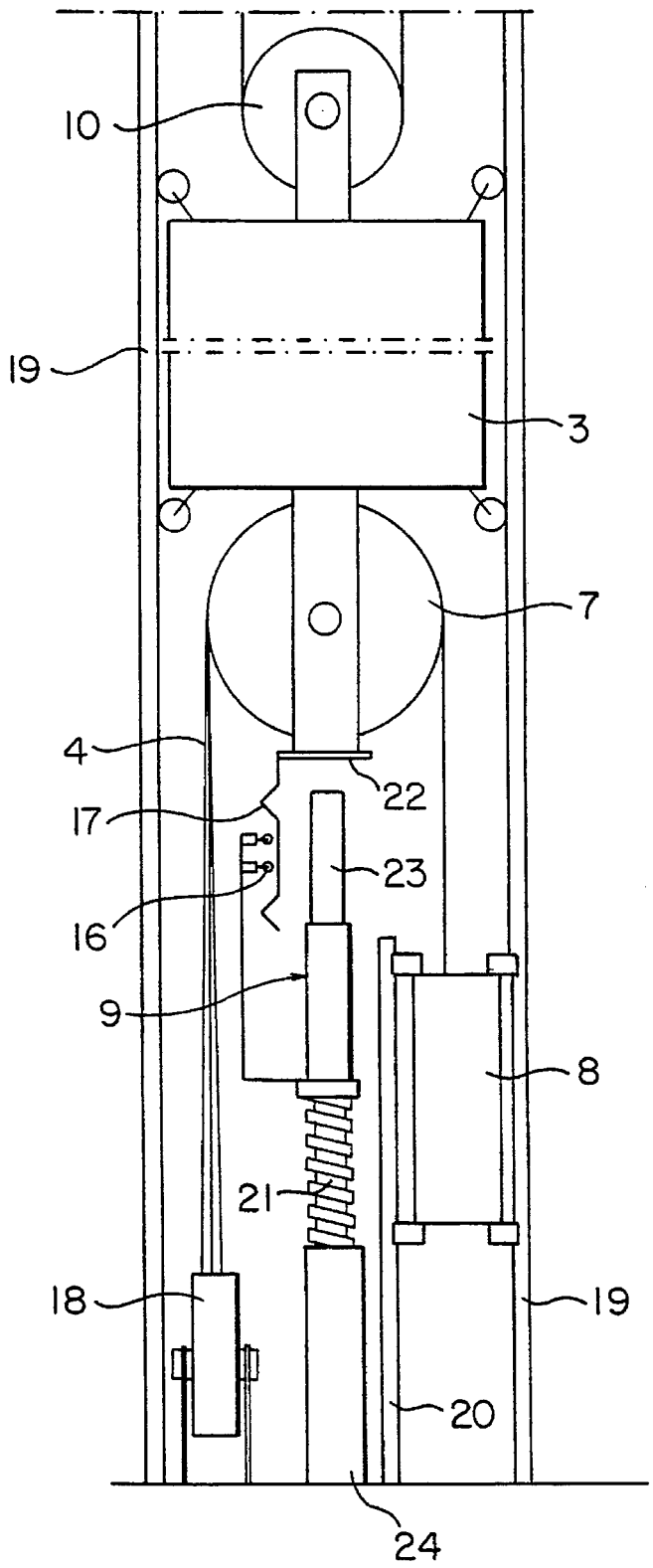

Another problem in high-rise elevators is the elongation of the hoisting and compensating ropes. Usually the car and counterweight are suspended to a ratio of 1:1 or 2:1. In both cases, the buffers are placed below the car and counterweight. Buffers are used at the extreme ends when, in cases of malfunction, the car travels beyond the topmost or bottommost floor. When the car is at the bottommost floor, some distance remains between the car and the buffer, called car overtravel distance. Similarly, when the car is at the topmost floor, a counterweight overtravel distance remains between the counterweight and its buffer. When the ropes are elongated and the car still stops accurately at the extreme floors, the counterweight overtravel distance is reduced. In prior art, this counterrweight overtravel distance has been corrected by removing the extra pieces attached to the bottom of the counterweight. A disadvantage with extra pieces is that they occupy a certain space and therefore increase the safety distance at the upper and lower ends of the shaft. In high-rise elevators, there is also in the lower part of the shaft a compensating device which tightens the compensating ropes between the car and the counterweight. As the hoisting rope and the compensating rope are elongated, the tension device goes gradually downwards. To prevent the compensating ropes from becoming loose, enough space has to be provided below the tension device to allow it to go as far down as required by the elongation. This necessitates rather deep deep pits in the shaft in cases of a large hoisting height. Even so, the ropes generally have to be shortened a few times during the early part of the service life of the elevator. This problem can be solved by employing a solution as illustrated by FIG. 1 and a buffer arrangement as illustrated by FIG. 4.

The invention provides considerable advantages:

In high-rise freight elevators suspended to 2:1, a large number of compensating ropes and a heavy tension weight are needed. By using a double compensation suspension ratio according to the invention, the number of ropes can be halved and the size of the tension weight reduced.

In very tall buildings, the invention allows the application of elevator designs according to FI patent 82823 and DE publication 1251926, involving considerable savings in the guide rail length and the number of attachments as the counterweight only travels through half the travel of the car.

An existing solution for a locking device preventing counterweight bounce can be applied in the solution of the invention.

Rope elongation can now be compensated by using an adjustable buffer.

The adjustable buffer system is a cheap solution and easy to manufacture.

The buffer has a simple construction, for its height can be reduced by tightening an adjusting screw and increased by loosening the screw, or the adjustment can take place automatically.

Figure 2:
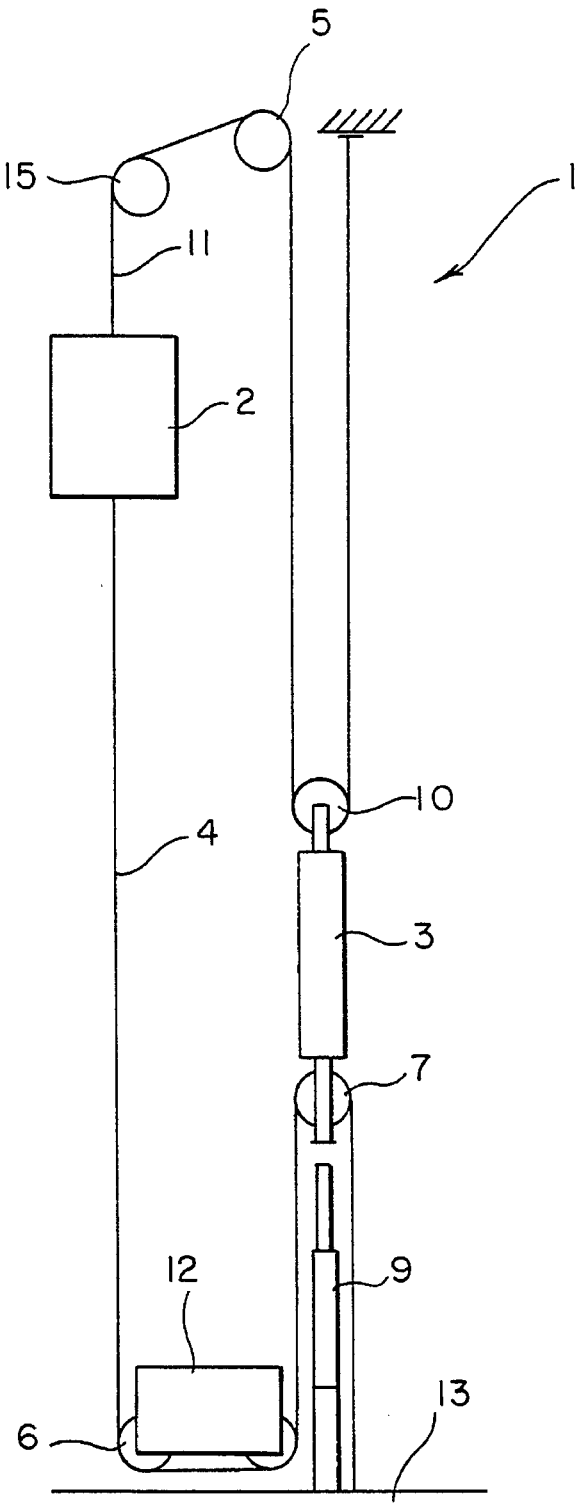
Figure 3:
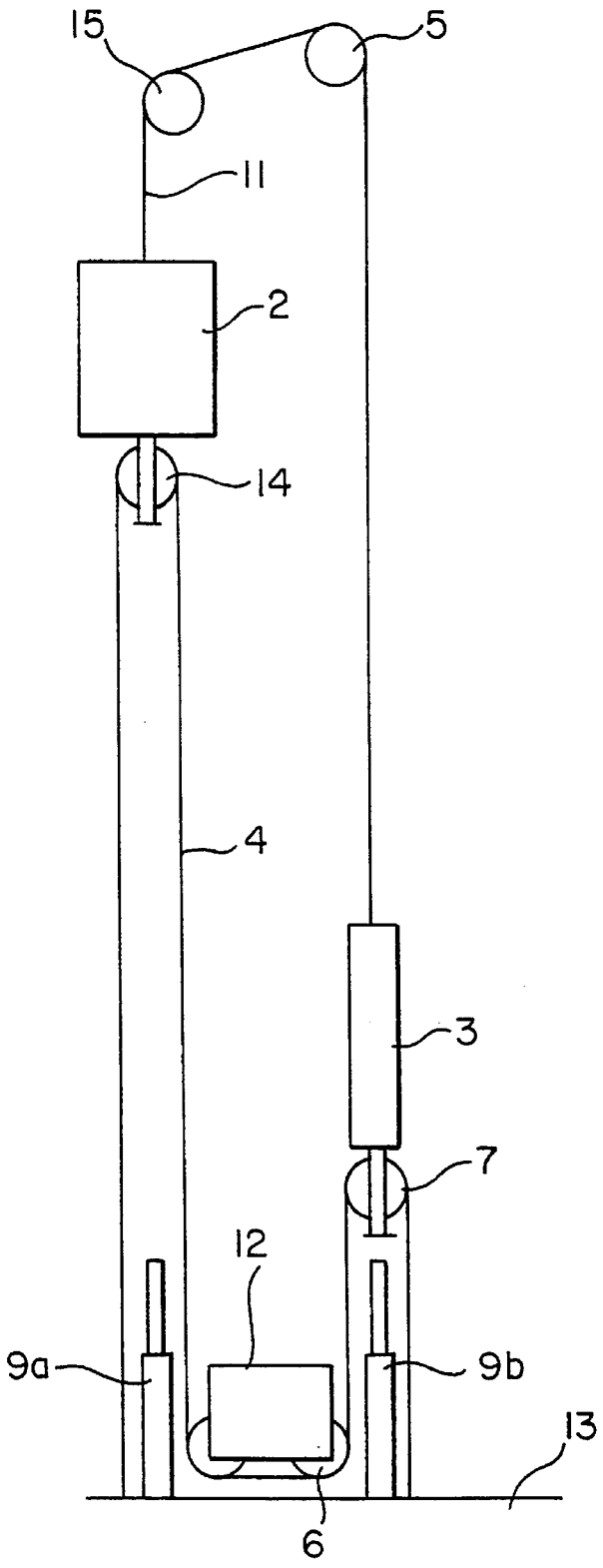

In the following, the invention is described in detail by the aid of an example by referring to the attached drawings, in which FIG. 1 presents a solution according to alternative I of the invention, FIG. 2 presents a solution according to alternative II of the invention, FIG. 3 presents a solution according to alternative III of the invention, and FIG. 4 shows a more detailed view of the buffer solution used in the various embodiments of the invention.

FIG. 1 shows an elevator 1 comprising an elevator car 2, a counterweight 3 and elevator suspension ropes 11 on which the elevator car 2 and the counterweight 3 are suspended, and a traction sheave 5 and a diverting pulley 15, whose motion is transmitted via the suspension ropes 11 to the elevator car 2 and counterweight 3. The elevator car 2 is suspended with a suspension ratio of 1:1 and the counterweight 3 with a suspension ratio of 2:1. In this solution the compensating ropes 4 run from the car 2 to diverting pulleys 6 mounted on the floor and further via a diverting pulley 7 in the counterweight 3 to a tension weight 8 attached to the end of the rope. The tension weight can move vertically as the ropes 4 and 11 are elongated. In this invention, the suspension ratio of the compensating ropes is the same as that of the suspension ropes, i.e. 1:1 on the car side and 2:1 on the counterweight side, so in this case their mutual coefficient is 1. In addition, a buffer structure 9 belonging to the buffer arrangement is provided below the counterweight.

FIG. 2 presents another alternative, in which the suspension ratio of the elevator car 2 and counterweight 3 is the same as in FIG. 1. The compensating rope 4 is attached to the bottom of the elevator car 2 and runs from there via the diverting pulleys 6 of the tension device 12 and over a diverting pulley 7 below the counterweight 3 to a rope anchorage placed on the bottom 13 or wall of the elevator shaft. The tension device 12 can move in the vertical direction as the ropes 4 and 11 stretch. In this solution, the suspension ratio of the compensating ropes is the same as the suspension ratio of the suspension ropes in FIG. 1, so the mutual coefficient of the suspension ratios is also 1. In this solution, too, a buffer structure 9 belonging to the buffer arrangement is placed below the counterweight 3.

In FIG. 3, the car 2 and the counterweight 3 are suspended by means of suspension ropes 11, both with a suspension ratio of 1:1. Both ends of the compensating rope 4 are attached to the bottom 13 of the shaft. The compensating rope 4 is tightened via diverting pulleys 7 and 14 by means of a tension device 12, which is provided with diverting pulleys 6. The tension device 12 can move in the vertical direction. It is possible to add to the solution according to FIG. 3 a rope tensioning arrangement as shown in FIG. 1 using a tension weight 8, as well as fixed diverting pulleys 6. In addition, there is a buffer structure **9*b* belonging to the buffer arrangement below the counterweight 3 and a buffer structure 9*a* below the car 2**. In this case, the suspension ratio of the suspension ropes is 1:1 and the suspension ratio of the compensating ropes is 2:2, so the mutual coefficient of the suspension ratio is 2.

FIG. 4 shows a more detailed view of the bottom part of the elevator shaft. The counterweight 3 is shown with a section removed. Above the counterweight 3 is a diverting pulley 10 and below it another diverting pulley 7. The compensating rope 4 comes up from diverting pulley 18 to the diverting pulley 7 below the counterweight 3, goes around it and is attached to a tension weight 8. The counterweight 3 moves vertically in the elevator shaft along guide rails 19. The tension weight 8 moves along guide rails 20 and 19 in the bottom part of the elevator shaft. Due to rope elongation, the tension weight 8 moves gradually downwards. The rope elongation is the reason why the buffer structure 9 at the bottom of the elevator shaft should preferably be adjustable. The buffer structure 9 has a construction comprising a base part 24 with a screw 21 for height adjustment, mounted on the bottom of the elevator shaft below the counterweight 3. Mounted on the upper end of the screw 21 is a buffer part 23, whose top end receives a stop block 22 in the lower part of the counterweight 3 when the latter comes so far down that it is pressed against the buffer part 23. One 20 of the guide rails of the tension weight 8 is short as compared to the counterweight guide rail 19, and the upper end of rail 20 remains below the upper surface of the buffer part 23 even when the latter is compressed and adjusted to its lowest position. When a new elevator is being installed, the height of the buffer part 23 is so adjusted that, when the counterweight 3 is in its low position, a suitable overtravel distance is left between the stop block 22 and the buffer part 23. In the course of time, the elongation of the tension ropes 11 will reach a stage where the counterweight 3 goes down beyond its allowed low position. To avoid this, the base 24 the buffer part 23 has been made adjustable so that by turning the screw 21 or lowering a hydraulic cylinder, the buffer part 23 is also lowered. In this way, the clearance between the buffer part 23 and the stop block 22 of the counterweight 3 can be adjusted to a suitable value whenever necessary. This adjustment can also be automatized by adding limit switches 16 to the buffer base and attaching a track 17 to the counterweight 3. These determine a certain overtravel zone between the buffer part 23 and the stop block 22. The adjustment can be performed electrically by means of a motor at given intervals when the car is at the top floor and the counterweight in the low position. The motor transmits a vertical motion to the screw or opens a path for oil flow to a hydraulic cylinder through a valve system. Such a buffer arrangement is also applicable to the solutions according to FIG. 2 and 3, but a deep pit in the shaft is needed and possibly also the compensating ropes will have to be shortened, in which case all the advantages will be lost. The solutions according to FIG. 2 and 3 can be successfully used with all the advantages by adding a drum to the fixed end of one of the ropes and winding a portion of the compensating rope corresponding to the elongation onto the drum.

It is obvious to a person skilled in the art that different embodiments of the invention are not restricted to the examples described above, but that they may instead be varied within the scope of the following claims. For example compensating ropes are intended to encompass belts, chains, etc. The tension weight in FIG. 1 can be suspended via an additional diverting pulley on the wall or bottom of the shaft. There may be one or more diverting pulleys in conjunction with the compensating rope or the suspension rope, and similarly there may be more than one diverting pulley in conjunction with the car. The places of the traction sheave and of the diverting pulley in conjunction with it can be interchanged. It is also obvious to the skilled person that the word "car" encompasses a "car frame" and "counterweight-"encompasses "counterweight frame" or "counterweight tank", in the buffer structure, the screw can be replaced by a hydraulic cylinder or other solutions permitting vertical adjustment, e.g. a telescopic structure or a toothed rack or the like, by means of which the buffer structure can be locked at a given height. Instead of limit switches and a track, any other distance measuring devices and structures can be used.

I claim:

1. An elevator including a compensation rope arrangement comprising:

an elevator car;

a counterweight;

a set of elevator suspension ropes on which said elevator car and said counterweight are suspended;

a set of compensating ropes operatively associated with said elevator car and said counterweight;

at least one compensation diverting pulley fixedly mounted in place so that it cannot move in the vertical direction, for diverting said compensating ropes; and a tension weight placed at one end of the compensating ropes, said tension weight being able to move in the vertical direction;

wherein a suspension ratio of the compensating ropes is the same or multiplied by a constant as a suspension ratio of the suspension ropes, and the suspension ratio of the suspension ropes on the side of the car is different than the suspension ratio of the suspension ropes on the side of the counterweight.

2. An elevator including a compensation rope arrangement as claimed in claim 1, wherein the suspension rope and compensation suspension ratios on the side of the elevator car are 1:1 and the corresponding ratios on the side of the counterweight are 2:1.

3. A buffer arrangement for compensating the elongation of the suspension and compensation ropes of an elevator, the elevator including a counterweight connected to the suspension and compensation ropes, the counterweight having a vertical movement, the buffer arrangement comprising a buffer structure fixed in place below the counterweight and being pressed by the counterweight when the counterweight reaches a low point in the vertical movement, said buffer structure including adjustment means for adjusting the buffer structure in the vertical direction while the buffer structure remains fixed in place, in order to compensate for a change in the low point due to the elongation of the suspension or compensation ropes.

4. The arrangement of claim 3, wherein the suspension and compensation ropes have respective tensions, the tensions remaining unaffected by the adjustment of said adjustment means.

5. The arrangement of claim 3, wherein the suspension and compensation ropes have respective lengths after elongation, the lengths remaining unaffected by the adjustment of said adjustment means.

6. The arrangement of claim 3, said adjustment means comprising an adjustment screw, and wherein rotation of said adjustment screw adjusts the buffer structure in the vertical direction.

7. An arrangement for compensating an elongation of suspension and compensation ropes of an elevator, comprising:

an elevator car;

a counterweight;

suspension and compensation ropes linking said elevator car and said counterweight; and a buffer structure fixed in place below the counterweight and provided with means for adjusting the buffer structure in the vertical direction while the buffer structure remains fixed in place.

8. An arrangement for compensating an elongation of suspension and compensation ropes of an elevator as claimed in claim 7, wherein the buffer structure comprises:

a buffer part; and an adjustment screw having a rotation, the rotation vertically adjusting said buffer part in the vertical direction.

9. An arrangement for compensating an elongation of suspension and compensation ropes of an elevator as claimed in claim 8, further comprising:

means for automatically adjusting the screw in the vertical direction.

10. An arrangement for compensating an elongation of suspension and compensation ropes of an elevator as claimed in claim 7, wherein the buffer structure comprises:

a buffer part; and a hydraulic cylinder for vertically adjusting the buffer part.

11. An arrangement for compensating an elongation of suspension and compensation ropes of an elevator as claimed in claim 10, further comprising:

means for automatically adjusting the hydraulic cylinder in the vertical direction.

12. An elevator including a compensation rope arrangement, comprising:

an elevator car;

a counterweight;

a set of elevator suspension ropes on which said elevator car and said counterweight are suspended; and a set of compensating ropes operatively associated with said elevator car and said counterweight;

wherein a suspension ratio of the compensating ropes corresponds to a product of the suspension ratio of the suspension ropes and a constant which is greater than one, and the suspension ratio of the suspension ropes on the side of the car is the same as the suspension ratio of the suspension ropes on the side of the counterweight.

13. An elevator including a compensation rope arrangement as claimed in claim 10, further comprising:

a drum fixed so that it cannot move in the vertical direction, said compensating ropes being wound onto said drum to compensate for elongation of the suspension or compensating ropes.

14. An elevator including a compensation rope arrangement as claimed in claim 12, further comprising:

an elevator shaft for said elevator car, said elevator shaft having a bottom and at least one wall;

a diverting pulley attached to said counterweight, for diverting said compensating ropes;

a tension device which is able to move in the vertical direction, said tension device having a diverting pulley for diverting said compensating ropes; and wherein said compensating ropes are attached to the bottom or wall of said elevator shaft.

15. An elevator arrangement comprising:

an elevator in an elevator shaft;

a counterweight in the elevator shaft and connected to said elevator by suspension and compensation ropes; and a buffer structure, said buffer structure including:

a base having a first surface for attachment to the elevator shaft;

a buffer part having a top surface for contacting the counterweight; and adjustment means connected to said base and to said buffer part, for adjusting a distance between the first surface and the top surface.

16. The elevator arrangement of claim 15, wherein said adjustment means includes a hydraulic cylinder.

17. The elevator arrangement of claim 15, further comprising:

automatic means for automatically controlling said adjustment means to adjust the distance between the first surface and the top surface.

18. The elevator arrangement of claim 17, wherein said automatic means includes:

a distance measuring device for detecting an overtravel zone of the counterweight relative to said buffer part and for producing an overtravel signal; and a motor responsive to said overtravel signal for controlling said adjustment means to adjust the distance between the first surface and the top surface.

19. A buffer structure for use in combination with an elevator system, comprising:

a base for connection to a first surface in an elevator shaft;

a buffer part having a top surface for contacting a component of the elevator system; and an adjustment screw connected to said base and to said buffer part, said adjustment screw adjusting a distance between the first surface and the top surface as said adjustment screw is rotated.

20. The buffer structure of claim 19, further comprising:

means for automatically rotating the adjustment screw in order to adjust the distance between the first surface and the top surface.

* * * * *